United States Patent [19]

Uselton

[11] 4,366,677

[45] Jan. 4, 1983

[54] HEAT PUMP WATER HEATER WITH REMOTE STORAGE TANK AND TIMED TEMPERATURE SENSING

[75] Inventor: Robert B. Uselton, Dallas, Tex.

[73] Assignee: Atlantic Richfield Company, Los Angeles, Calif.

[21] Appl. No.: 275,966

[22] Filed: Jun. 22, 1981

[51] Int. Cl.[3] ..... G05D 23/32; F25B 27/02

[52] U.S. Cl. ..... 62/157; 62/238.6

[58] Field of Search ..... 62/157, 181, 182, 183, 62/185, 231, 238.6; 165/12, 18; 236/26 R; 126/419, 421, 437

[56] References Cited

U.S. PATENT DOCUMENTS

| | | | |
|---|---|---|---|
| 2,042,812 | 6/1936 | Tull et al. | 165/18 |
| 2,632,306 | 3/1963 | Ruff | 62/238.6 |
| 3,961,156 | 6/1976 | Patton | 236/21 B |
| 3,976,123 | 8/1976 | Davies | 165/29 |
| 4,125,107 | 11/1978 | Nurnberg | 165/18 |
| 4,293,093 | 10/1981 | Raymond et al. | 62/238.6 |
| 4,299,098 | 11/1981 | Derosier | 62/238.6 |
| 4,314,456 | 2/1982 | Harnish | 62/238.6 |

*Primary Examiner*—William E. Wayner

*Assistant Examiner*—Harry Tanner

*Attorney, Agent, or Firm*—James C. Fails; Rod W. MacDonald; Dave Folzenlogen

[57] ABSTRACT

What is disclosed is a water heating system characterized by a remote hot water storage tank having water interconnections with a heat pump unit and a remote, timed water circulating pump and water circuit incorporating temperature sensor and thermostat. The heat pump unit is adapted to be employed at a location near a kitchen or laundry room and includes conventional constituents such as compressor, condenser, expansion device, and evaporator connected in a closed refrigerant circuit; blower for circulating air from conditioned space across the evaporator; and pump for circulating water past the hot refrigerant gas in the condenser. The condenser comprises a double-walled heat exchanger for preventing contamination between the respective fluids. The heat pump unit comprises a cabinet housing the same and having a warm air inlet adjacent its bottom and cool air outlet adjacent its top. The control means enables periodically circulating water to sense its temperature and turning on the heat pump to add heat as needed.

6 Claims, 8 Drawing Figures

51a
51
39
37
41
43
29
33
53
55
32
21
49
25
23
19
35
46
15
47
57
47a
57a

HEAT PUMP WATER HEATER WITH REMOTE STORAGE TANK AND TIMED TEMPERATURE SENSING

FIELD OF THE INVENTION

This invention relates to a heat pump device for heating water. More particularly, this invention relates to a heat pump device for heating water while simultaneously cooling air that is connected by water conduits to a remotely disposed storage tank and having timed means for circulating the water and sensing the temperature thereof for adding heat as needed.

DESCRIPTION OF THE PRIOR ART

A wide variety of ways for heating water have been developed, the water being used interiorly of buildings; such as a home, cafe, small business, or the like. As is recognized, most of the earlier water heaters required actual creation, or production, of the heat; as by electrical resistance heating, or by burning gas or other combustibles, such as coal, fuel oil or the like. With increasing scarcity of depletable energy, more efficient ways of heating water are being utilized. For example, early in the twentieth century it was recognized that heat pumps could be employed to merely pump heat from one location to another rather than having to create the heat. Consequently, their coefficient of performance exceeded one; ordinarily about 2. With today's technology the coefficient of performance can be increased to higher levels. Illustrative of the types of prior art approaches to employing heat pumps to heat water are those described in the following U.S. Pat. Nos. 2,095,017; 2,516,094; 2,575,325; 2,690,649; 2,632,306; 2,751,761; 2,716,866; 4,091,994; 4,098,092; 4,103,509; 4,134,274; 4,141,222; 4,142,379 and 4,173,872. This prior art has disclosed a wide variety of attempts to improve efficiency of the heat pump by varying capacity, employing the superheat from the compressed refrigerant, by immersing the refrigerant coil in the hot water storage tank or by employing it as a part of a larger system including a hot water circulation and radiator heating system. The systems have been disadvantageous in employing complex instrumentation with a plurality of units located at different locations and have not fully taken advantage of the ability to simultaneously heat the water and cool the air for being used interiorly of the building for air conditioning during a hot summer or the like. Specifically, the prior art has failed to provide a water heater connecting to a remote storage tank that can be easily emplaced in or adjacent air conditioned space and maintain the water at the desired temperature above a minimum temperature without complex instrumentation.

SUMMARY OF THE INVENTION

Accordingly, it is an object of this invention to provide a heat pump water heater that can be employed to cool the air simultaneously with heating the water and obviate the necessity for complex instrumentation between the water heater and the heat pump unit.

It is a specific object of this invention to provide a heat pump water heater satisfying the above objective and also providing positive water circulation through the heat pump unit in order to determine the temperature without complex instrumentation and provide the heat pump with advantageous construction that can be emplaced adjacent or within a kitchen, laundry room or the like to cool air simultaneously with heating the water.

These and other objects will become apparent from the descriptive matter hereinafter, particularly when taken in conjunction with the appended drawings.

In accordance with this invention there is provided a water heating system adapted for use in a building such as a home or the like and having a remote hot water storage tank fluidly connected with the unit that includes a heat pump having a compressor, condenser, expansion device and evaporator connected in a closed circuit containing a refrigerant and adapted to circulate hot refrigerant gas in heat exchange relationship with the water for heating the water and to circulate cool refrigerant in heat exchange relationship with the air for cooling the air; all with a control circuit that enables circulating the water for monitoring the temperature on periodic intervals to maintain the temperature in the remote hot water storage tank above a minimum.

In a preferred embodiment, the condenser comprises a double-walled heat exchanger having respective tubular passageways for, respectively, the refrigerant and water so as to prevent contamination. The heat pump unit is adapted for being located in a place adjacent to or within conditioned space and comprises a cabinet having a warm air intake adjacent its bottom and cool air outlet adjacent its top.

BRIEF DESCRIPTION OF DRAWINGS

FIG. 1 is a schematic view of one embodiment of this invention showing the hot water storage tank remotely disposed in a closet storeroom or garage with the heat pump unit disposed in a laundry room or the like.

DESCRIPTION OF THE PREFERRED EMBODIMENTS

Figure 1:
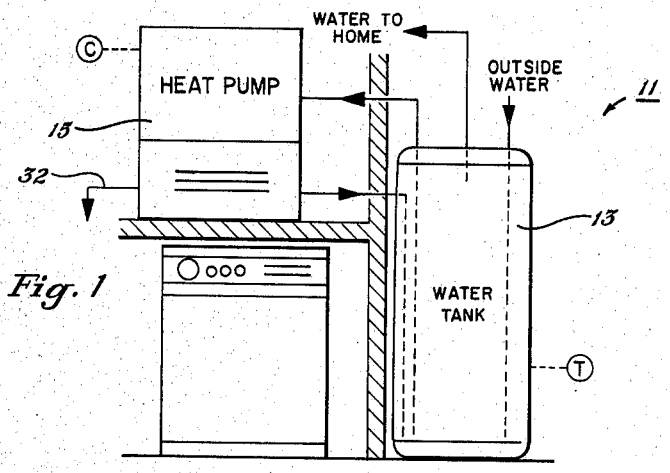
Figure 2:
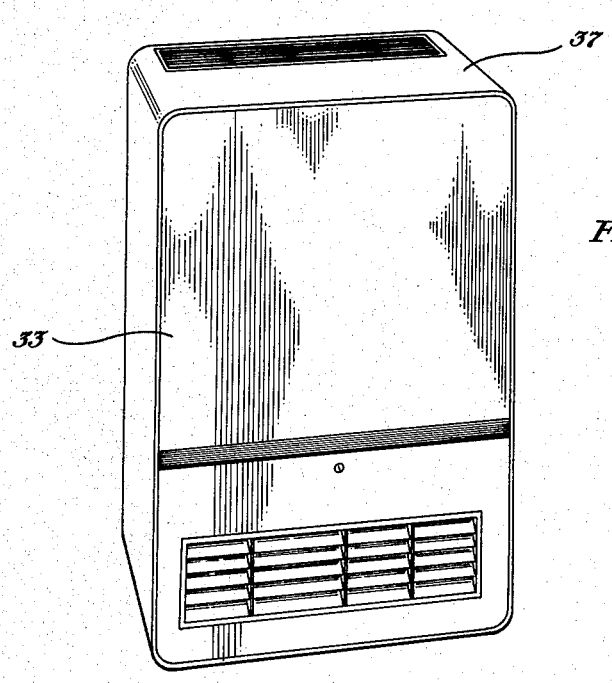
FIG. 2 is a perspective view of a heat pump unit in accordance with the preferred embodiment of this invention.
Figure 3:
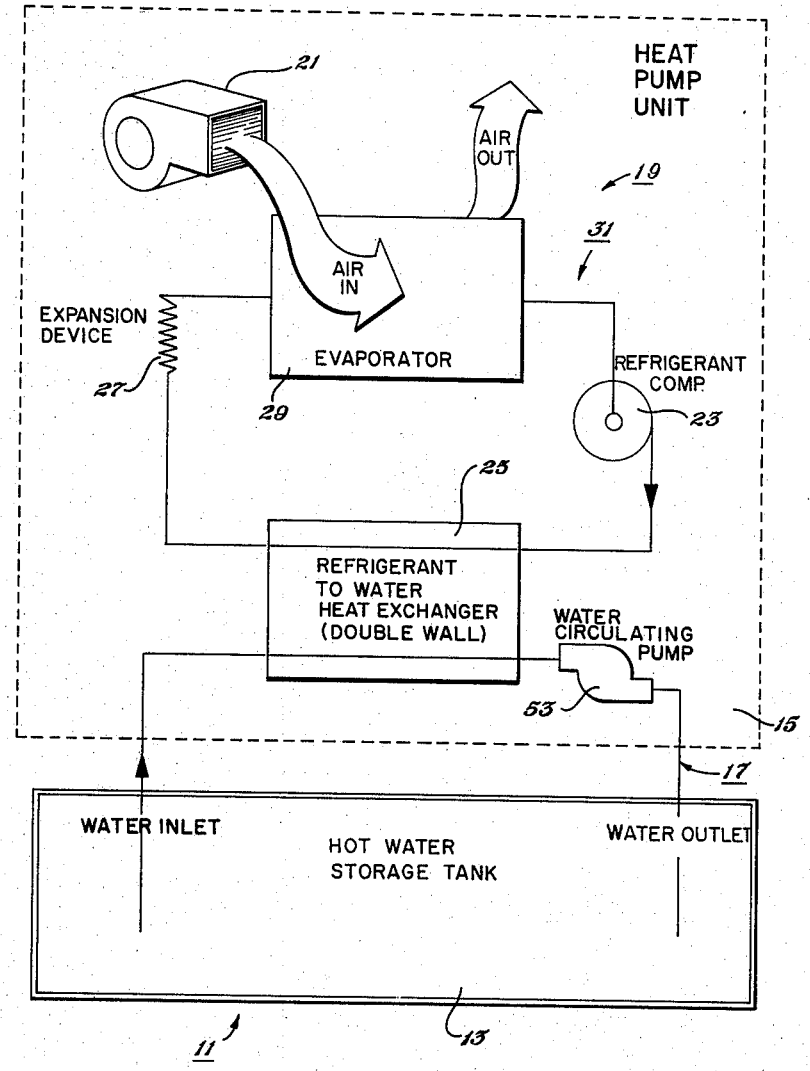
FIG. 3 is a schematic diagram showing the respective elements and interconnections.

Referring to FIGS. 1 and 3, a water heating system 11 includes a remote hot water storage tank 13, a heat pump unit 15 and water circulating conduits and means 17, FIG. 3.

The hot water storage tank 13 may comprise any of the conventional vessels. For example, the storage tank may comprise a steel tank that is lined with some non-corrosive interior such as copper, glass or the like. Ordinarily, the hot water storage tank is surrounded by insulation and disposed interiorly of a decorative cabinet (not shown). The hot water storage tank and cabinet may be cylindrically shaped although any other shape may be employed as desired depending upon the nature of the installation.

Figure 4:
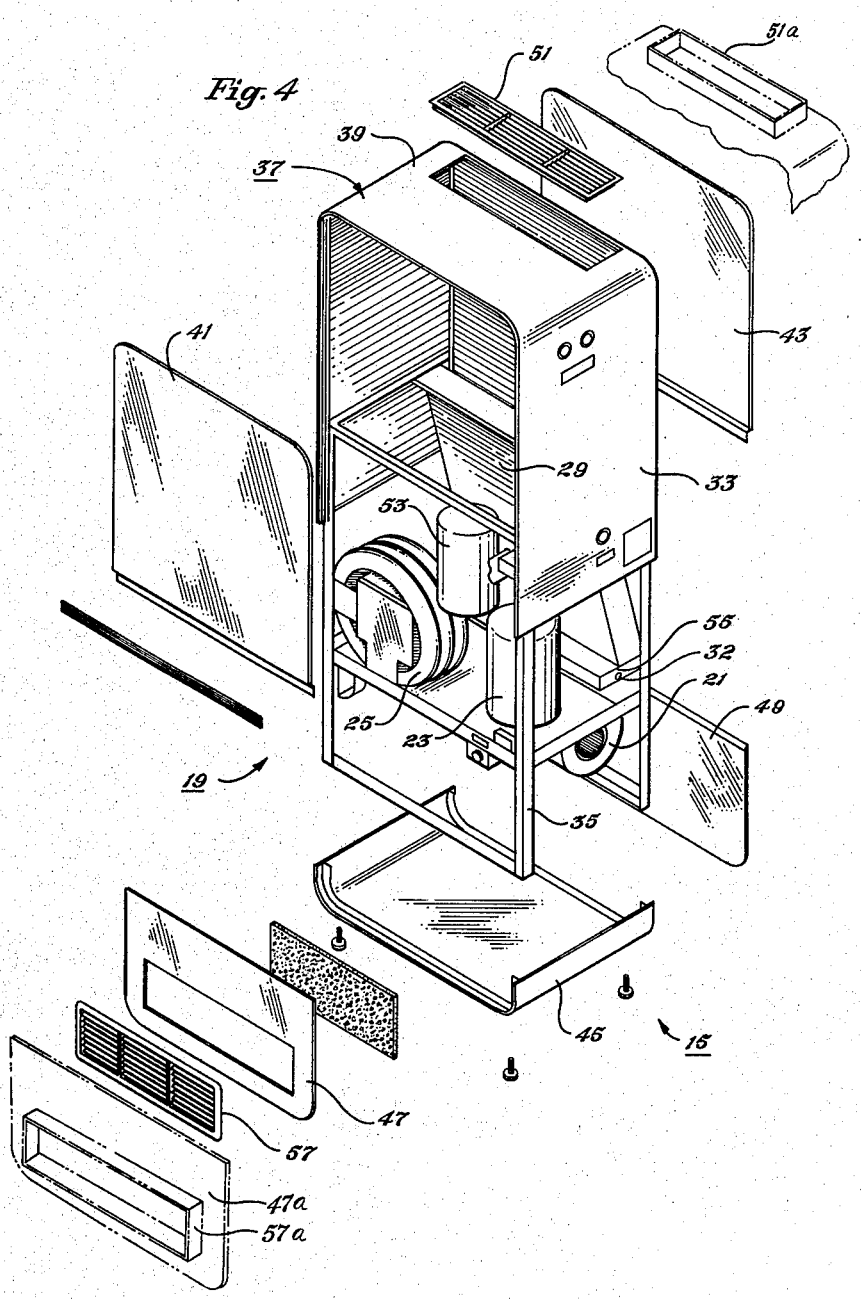
FIG. 4 is an exploded view of the heat pump unit of FIG. 2.

The heat pump unit 15, FIGS. 1 and 4, includes a refrigerant system 19, FIGS. 3 and 4 and a blower means 21 for circulating air. The interconnecting conduits are omitted from FIG. 4 in the interest of clarity.

The refrigeration system 19 includes a compressor 23, a water-cooled condenser 25, an expansion device 27, FIG. 3, and a refrigerant-to-water evaporator 29 connected in a closed circuit 31 containing a refrigerant. The circuit and recited elements are adapted to circulate hot refrigerant gas in heat exchange relationship with the water for heating the water which is circulated from hot water storage tank 13 and to circulate cold refrigerant in heat exchange relationship with the air for cooling the air which is circulated within the conditioned air space. Drain 32 is provided to conduct away any condensate which drains from the evaporator.

The compressor 23 may comprise any of the types of compressors ordinarily employed in heat pumps. Preferably, it comprises a rotary compressor to take advantage of the lower power consumption that can be effected with a low pressure ratio; such as disclosed in co-pending application Ser. No. 06/050,548; Amir L. Ecker, inventor, entitled "Heat Pump Employing Optimal Refrigerant Compressor For Low Pressure Ratio Applications"; assigned to the assignee of this invention. The details of application Ser. No. 06/050,548 are incorporated herein by reference for details that are omitted herefrom. Such a low pressure ratio can be effected with a heat pump for heating water and for cooling circulated air within a building, where the air is about 70–80° F. (21°–27° C.). As is recognized these rotary compressors may comprise either the rolling piston rotary compressors or the rotating vane rotary compressors.

The condenser 25 may comprise any of the conventional condensers that provide both a water path and a refrigerant path for exchanging heat between the hot compressed refrigerant gas and the water. One of the improvements of this invention, however, is having the condenser in the form of a helical coil having both refrigerant and water paths for heat exchange between the hot compressed refrigerant gas and the water, the coil being small and readily emplaced in the heat pump unit, as illustrated in FIG. 4.

The expansion device 27 may comprise any of the conventional expansion valves conventionally a part of the heat pumps. The expansion device is preferably a thermostatic expansion valve that is responsive to temperature or pressure in the suction line to the compressor and controls the flow of refrigerant to the evaporator to insure that no liquid flows through to the compressor 23.

The evaporator 29 may ordinarily comprise any conventional air-to-refrigerant evaporator for vaporizing the liquid refrigerant which was condensed in the condenser. The vaporizing is done, for example, by circulation of the air in heat exchange relationship with the condensed liquid refrigerant while simultaneously lowering the pressure on the refrigerant to allow it to vaporize. The lowering of the pressure is done, as is recognized, by suction of the compressor reducing the pressure in the evaporator while the thermostatic expansion valve, or expansion device 27 controls the flow of liquid refrigerant into evaporator 29. One of the improvements of this invention comprises having the evaporator in the form of a heat exchange coil disposed within the heat pump unit such that air can be circulated upwardly therethrough for cooling the air. A drain pan assembly 55 allows draining water condensed from the air.

The blower means 21 may comprise any of the blowers employed for circulating the air in a residence, small commerical building or the like. As illustrated in FIG. 4 the blower 21 takes suction, or inlet air, through the louver 57 of panel 47 and discharges upwardly past the compressor 23 and evaporator 29 and through louver 51. Optionally, louvers 51 and 57 can be replaced by duct flanges 51*a* and 57*a* which provides means for connecting to a duct which supplies air to and from an adjoining conditioned space. Ordinarily, the blower will comprise a powered squirrel cage blower that is driven by an electric motor or the like. The blower system has pressure-flow characteristics which permit the attachment of ducts to the heat pump so that air from adjacent conditioned space can be utilized. These blowers and motors are conventional and need not be described in detail herein.

The refrigeration system 19 and blower means 21 are housed within the exterior housing 33. Specifically, the housing 33 is in the form of a cabinet having internal framework 35 and an external skin 37. As illustrated, the external skin 37 is comprised of a plurality of pieces of material such as metal or plastic. These include the main upper skin 39, front and back panels 41, 43; bottom 45; front and back lower panels 47, 49 and louver 57 (or duct flange 57*a*); and the upper louver 51 (or optionally duct flange 51*a*). This allows air to be taken in at the bottom and circulated upwardly past the respective components, including evaporator 29 and out the top louver 51 (or optionally through ducts connected to duct flanges 51*a* or 57*a* ). Panels 47 and 49 are interchangeable so air can be made to enter either face of the enclosure.

Figure 5:
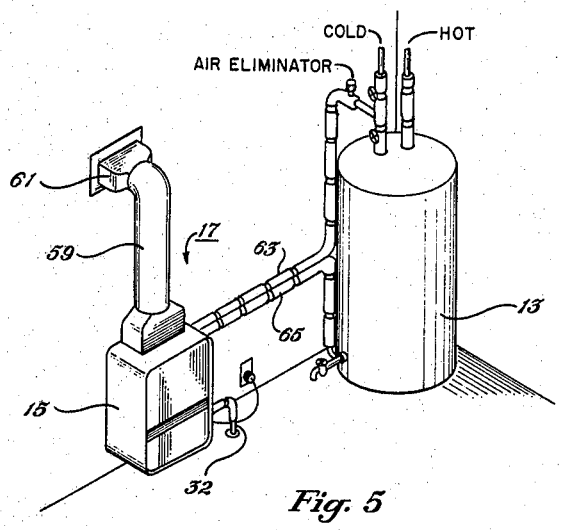
FIG. 5 is a schematic view of one embodiment of this invention showing the hot water storage tank and the heat pump disposed in a space adjacent to a conditioned space.
Figure 6:
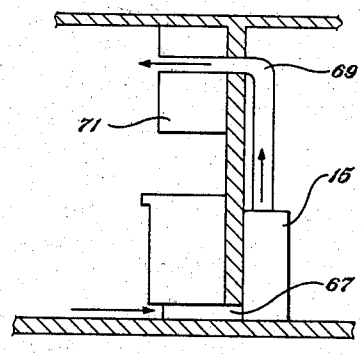
FIG. 6 and 7 show alternate locations for air supply and return openings in a kitchen.
Figure 7:
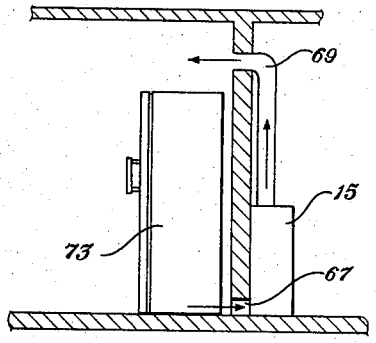

The heat pump water heater of this invention has the flexibility that a wide variety of installations can be employed taking conditioned air from a conditioned air space, venting it to a conditioned air space, or both taking it from and venting it back to a conditioned air space. For example, in FIG. 5, there is shown the unit in which the remote storage tank 13 is installed in a garage, laundry room, closet or the like and a heat pump unit 15 has its drain 32 suitably connected. The heat pump unit 15 has its cooled discharge air sent through round flexible duct 59 and thence out through a rectangular duct 61 into the air conditioned space. Suitable insulated conduits 63, 65 serve as the conduits for the circulating conduits and means 17. In FIG. 6, the heat pump unit 15 is shown having the air return 67 in the kick space under the kitchen cabinet with the air discharge duct 69 discharging through the soffit 71. Similarly, in FIG. 7, the heat pump unit 15 has its air return 67 behind a refrigerator or the like and has its discharge 69 discharging over the top of the refrigerator 73.

Figure 8:
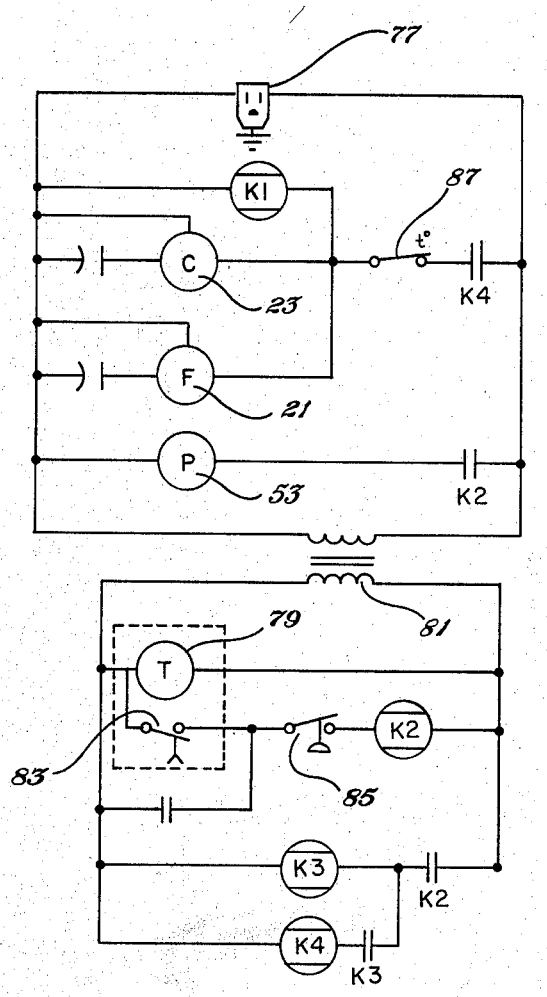
FIG. 8 is a schematic diagram of the control circuit in accordance with one embodiment of this invention.

It is advantageous in all of these embodiments to employ remote temperature sampling rather than requiring an elaborate control circuit. A typical remote sampling circuit is illustrated in FIG. 8. Referring to FIG. 8, a typical grounded source of power is shown by the outlet 77. Typically this will be a 115 volt, 60 Hertz, alternating current source, with ground. A timer 79 operates off a 24 volt transformer 81 connected into the power circuit. The timer turns on-after predetermined interval for a duration of time. For example, it may turn on each fifteen to thirty minutes and may remain on for an interval of from three to five minutes to allow time for sampling the temperature of the water that will be circulated. Specifically, when the timer turns on, it closes contacts 83 that are serially connected with the power source transformer 81 and relay K2. The relay K2 operates double pole contacts K2 for energizing pump 53 and relay K3. A high pressure cutout switch 85 on the refrigerant discharge side of the compressor is provided as a safety factor to cut out the compressor in the event that the temperature becomes too high. The contacts K1 of the K1 relay provide an alternate bypass around the timer when the K1 relay is energized by a thermostat switch 87. The temperature sensing means for the thermostat 87 is disposed in intimate contact with the water that will be circulated through the circulation conduit when the pump is energized. The compressor 23 is connected with run and starting circuit and capacitors and serially with the thermostat and the contacts K4 so as to run when both the thermostat and the relay contacts K4 are closed. Similarly the fan, or blower 21, is connected to start and run when a circuit path is provided by way of thermostat 87 and relay contacts K4. Running capacitors are provided for both the compressor and the fan. The pump 53 also is connected to circulate water when the contacts K2 are closed to provide a complete electrical circuit therefor. As indicated, energizing of the relay K2 also energizes relay K3. Closure of relay contacts K3 energizes relay K4. The respective relays are time delay relays of appropriate duration; for example sixty seconds; to provide in-line sequencing.

In operation, the timer 79 turns on at appropriate time to effect closure of the switch 83 and energizing of the relay K2. Energizing the relay K2 causes closure of the relay contacts K2 to both start pump 53 and energize K3 which effects closure of the relay contacts K3. This, in turn, energizes the relay K4 and effects closure of the relay contacts K4 to provide a circuit if the thermostat switch 87 closes because of low temperature. When the pump 53 is started, it circulates the stored hot water. The water temperature is sensed by at least one suitable sensor (not shown) for the thermostat switch 87. If water temperature is too low the thermostat switch 87 will close. In the unlikely event that the water temperature is too high the high pressure cutout switch 85 will cutout the compressor by way of the time sequencing relays and their contacts. It the thermostat switch 87 is closed, the compressor and fan are started and run to heat the water. Specifically, the relay K1 is energized to close the contacts K1 and provide an alternate path around the timer 79 until the thermostat switch 87 opens. The thermostat switch 87 is opened by the water temperature climbing above the predetermined minimum temperature at which it is set.

When the compressor 23 is turned on, the refrigerant is compressed and sent to the condenser where it is heat exchanged with the water to heat the water. The refrigerant is, in turn, condensed and passes through the expansion device 27 to the evaporator 29. The blower blows the air past the evaporator to heat exchange with the liquid refrigerant and cause it to vaporize and cool the air. The vaporized refrigerant is then returned to the compressor to complete the cycle. The cycle has the advantage of both heating the water and cooling the air.

As implied, the water is circulated through the water conduit 17 by the pump 53. The respective temperature sensors are located at any appropriate point in the system such as thermometer wells or the like.

When the thermostat indicates that the water in the tank has been heated to an adequate level, the active elements of the heat pump are deenergized by opening of the thermostat switches 87. This in turn deenergizes the relay K1 and opens the relay switches K1 so that the control circuit is back on the cycles of the timer 79.

A cycle of the timer 79 that has been found eminently satisfactory has been to turn it on each fifteen minutes to allow it to run for three and one half minutes to give time to circulate the water and bring the temperature sensors up to nearly the temperature of the water in the tank. The timer then opens the switch 83 and keeps the active timer switch open for eleven and one half minutes before it again effects circulation of the water.

From the foregoing it can be seen that this invention achieves the objects described hereinbefore.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter purpose being had to the appended claims.

I claim:

1. A heat pump water heater comprising:

a. a remote hot water storage tank having respective water inlet and outlet connections for connecting respectively with water supply, circulating and hot water piping system;

b. a heat pump unit adapted to transfer heat from air from conditioned space to water circulated from said remote hot water storage tank including:

i. a heat pump having a compressor, condenser, expansion device, and evaporator connected in a closed refrigerant circuit containing a refrigerant and adapted to circulate hot refrigerant gas in heat exchange relationship with water for heating said water and to circulate cold refrigerant in heat exchange relationship with air for cooling said air; said condenser comprising a double-walled heat exchanger having separate tubular passageways for, respectively, refrigerant and water; said evaporator comprising a heat exchanger having respective cold refrigerant passageways disposed in heat exchange relationship with respective air passageways;

ii. a blower means and air path for circulating air across said evaporator in heat exchange relationship with said cold refrigerant; said air path encompassing said evaporator;

said heat pump unit being portable and disposable at a location distant from said remote hot water storage tank; and c. water circuit and water circulating means for circulating water from said remote hot water storage tank through said condenser of said heat pump unit in heat exchange relationship with said hot refrigerant gas; said water circuit having its inlet and outlet in fluid communication with said remote hot water storage tank and connected with said water passageway of said condenser;

d. temperature sensing means and control means for sensing water temperature and energizing the heat pump unit when the sensed water temperature is less than a predetermined temperature; said temperature sensing means being disposed at a distance from said remote hot water storage tank and adjacent said heat pump unit and said water circuit so as to be responsive to the temperature of water flowed in said water circuit; said control means being connected also with said water circulating means and said heat pump unit so as to energize and deenergize said water circulating and said heat pump unit; and e. timer means being connected with said water circulating menas so as to effect energizing of said water circulating means on a periodic basis and retain said water circulating means energized for a time interval sufficiently long to circulate sufficient water to said temperature sensing means to enable sensing a temperature of the water closely approximating the temperature of the water in said remote hot water storage tank;

whereby said water is circulated periodically and heat is added as needed to maintain said water temperature above the predetermined minimum temperature.

2. The heat pump water heater of claim 1 wherein a sensing means having a cutout switch is connected into said control means so as to sense a parameter indicative of high temperature and stop said compressor when the temperature of said water exceeds a predetermined maximum temperature.

3. The heat pump water of claim 2 wherein said parameter is pressure of the refrigerant and said sensing means is a high pressure cutout control and switch on the refrigerant discharge side of the compressor.

4. The heat pump water heater of claim 1 wherein said periodic basis of said timer means is within the range of 15–30 minutes and retains said water circulating means energized for said time interval within the range of 3–5minutes.

5. The heat pump water heater of claim 4 wherein said periodic basis is each 15 minutes and said time interval for said water circulating means to remain energized by said timer means is about three and one half minutes.

6. The heat pump water heater of claim 1 wherein a thermostat is employed in said control means and connected with said temperature sensing means such that a conductive path bypassing said timer is provided when said temperature of said water is below said predetermined temperature such that said compressor, fan and pump continue to run until the temperature is raised, even if the timer opens its contacts, until said temperature is above said predetermined temperature and said thermostat switch is opened thereby.

* * * * *